US005156177A

United States Patent [19]

Bishoff

[11] Patent Number: 5,156,177

[45] Date of Patent: Oct. 20, 1992

[54] FLOW LOADING UNLOADER VALVE

[75] Inventor: David R. Bishoff, Stevens Point, Wis.

[73] Assignee: Woodward Governor Company, Stevens Point, Wis.

[21] Appl. No.: 602,717

[22] Filed: Oct. 24, 1990

[51] Int. Cl.[5] ..... F04B 49/02

[52] U.S. Cl. ..... 137/12; 137/569; 137/625.48; 251/31; 417/299

[58] Field of Search ..... 137/115, 116, 498, 499, 137/488, 12, 625.48, 569; 251/31, 30.01; 417/299

[56] References Cited

U.S. PATENT DOCUMENTS

| | | | |
|---|---|---|---|
| Re. 30,127 | 10/1979 | Ohms . | |
| 2,135,949 | 8/1938 | O'Conner | 137/488 X |
| 2,982,217 | 5/1961 | Thrap . | |
| 3,024,732 | 3/1962 | Nyman . | |
| 3,119,550 | 1/1964 | West et al. | 417/299 X |
| 3,224,456 | 12/1965 | Klein . | |
| 3,524,465 | 8/1970 | Sadler . | |
| 3,692,038 | 9/1972 | Hansen et al. | 137/116 |
| 3,723,025 | 3/1973 | Coakley | 137/116 X |
| 3,884,253 | 5/1975 | Murata et al. . | |
| 3,942,548 | 3/1976 | Murata et al. . | |
| 3,955,396 | 5/1976 | Carrieri . | |
| 3,977,102 | 8/1976 | Ohms . | |
| 4,015,620 | 4/1977 | Carrieri . | |
| 4,119,016 | 10/1978 | Pfeil et al. | 417/299 X |
| 4,171,708 | 10/1979 | Pareja . | |
| 4,172,466 | 10/1979 | Pattarini et al. | 137/488 |
| 4,173,866 | 11/1979 | Farr . | |
| 4,202,250 | 5/1980 | Zeuner et al. . | |
| 4,276,810 | 7/1981 | Zeuner et al. . | |
| 4,292,990 | 10/1981 | Pareja . | |
| 4,418,709 | 12/1983 | Hirsch . | |
| 4,535,966 | 8/1985 | Post et al. | 251/31 |
| 4,569,372 | 2/1986 | Blank . | |
| 4,730,543 | 3/1988 | Holmes . | |

FOREIGN PATENT DOCUMENTS

| | | | |
|---|---|---|---|
| 229147 | 2/1925 | United Kingdom | 137/488 |

*Primary Examiner*—Stephen M. Hepperle
*Attorney, Agent, or Firm*—Leydig, Voit & Mayer

[57] ABSTRACT

A flow loading unloader valve wherein the operating force for moving the valve from the unloaded condition to the loaded condition is supplied by the flow through the valve itself. The valve, which may be interposed between a fluid supply and a high pressure load, comprises a valve body, having an inlet, a working outlet, a bypass outlet, and a valve operator, which may include a spool, that controls the direction of flow through the body. Movement of the valve operator to change the valve from the unloaded condition to the loaded condition is accomplished by applying the differential pressure created by the flow of fluid from the inlet to the bypass outlet to the piston ends. As the pressure increases as a result of increased flow resistance through the valve, the valve operator moves from an unloaded to a loaded position, terminating flow to the bypass port and resulting in high pressure flow to the working outlet.

27 Claims, 7 Drawing Sheets

| FLOW RELATED SETTING | | | |
|---|---|---|---|
| FLOW GPM | WASHER ON TOP | WASHER ON BOTTOM | GAP |
| 10 | 10 | 0 | 2.413 |
| 20 | 10 | 0 | 2.300 |
| 30 | 10 | 0 | 2.212 |
| 40 | 10 | 0 | 2.136 |
| 50 | 0 | 10 | 2.001 |
| 60 | 1 | 9 | 1.934 |
| 70 | 2 | 8 | 1.872 |
| 80 | 2 | 8 | 1.814 |
| 90 | 3 | 7 | 1.760 |
| 100 | 3 | 7 | 1.706 |
| 120 | 4 | 6 | 1.611 |
| 140 | 5 | 5 | 1.523 |
| 160 | 6 | 4 | 1.460 |
| 180 | 7 | 3 | 1.365 |
| 200 | 8 | 2 | 1.221 |

FLOW LOADING UNLOADER VALVE

FIELD OF INVENTION

The invention relates generally to hydraulic systems, and more particularly to unloading valves.

BACKGROUND OF THE INVENTION

In high pressure hydraulic systems, pumps are often required to intermittently supply high pressure fluid to loads, such as accumulators, when the system requires replenishing. In order to allow the pump to come up to speed at light loads before the load of the high pressure accumulator is placed on the system, unloading valves are utilized. These valves controllably impose the hydraulic load on the pump at start-up and controllably release the load before the pump shuts down. Unloading valves require a source of motive power for their operation, and it has been conventional to utilize pressure taken from the high pressure system itself. This type of operation requires one or more lines from the high pressure system through a filter and a solenoid valve in order to supply adequate pressure to operate the unloading valve. These lines deliver high pressure fluid through a filtering system to a solenoid valve, which directs the flow of the fluid to the unloading valve to operate it. The use of high pressure lines can make installation, especially in the field, difficult and time consuming. Additionally, high pressure lines add to the overall cost of the valve, as well as the cost of initial or field installation. Furthermore, such a complex maze of high pressure lines can be dangerous in that the lines present unnecessary obstructions in the work place. An inadvertently disengaged line may expel high pressure hydraulic fluid and result in undesirable system down time required to repair the connection. Such disengagement also results in unreliable operation of the unloading valve, and, therefore, the high pressure loading system.

OBJECTS OF THE INVENTION

A primary object of the invention is to provide an uncomplicated, reliable hydraulic loading system. Another object is to provide an unloading valve, the operation of which does not rely on indirect logic. A related object is to eliminate the need for separate high pressure supply lines to operate the unloading valve.

A further object is to provide an adjustable unloading valve, the major structural elements of which may be adapted to accommodate a range of flow rates and operating pressures in various applications. A related object is to provide a valve that is adjustable with only minor changes in the initial set up of the valve. Another object is to provide an unloading valve that will operate effectively and reliably, and may be easily installed and maintained.

Yet another object is to provide a valve and hydraulic loading system that operates smoothly and quietly, and provides smooth, shock-free transitional loading and unloading.

SUMMARY OF THE INVENTION

In accomplishing these objectives in accordance with the invention, there is provided an unloading valve that is interposed between a fluid supply and a high pressure load, such as an accumulator. The valve comprises a valve body having an inlet, a working outlet, and a bypass outlet, and a valve operator, which controls the direction of flow through the body. Movement of the valve operator is achieved by applying to the valve operator an operating force created by the flow through the valve; during operation, the valve operator moves from an unloaded to a loaded position as the operating force increases as a result of the progressively reduced area of the bypass outlet path through the valve.

Inasmuch as the valve responds to flow from the system during loading to operate the valve itself, the invention eliminates the need for high pressure pilot piping and reliance on indirect logic. The valve may be utilized by simply installing it in the appropriate location in the supply piping. Furthermore, the valve may be set up differently from a group of common parts for use in a range of applications. This results in certain economies in both manufacture and stock keeping.

These and other features and advantages of the invention will be more readily apparent upon reading the following description of a preferred exemplified embodiment of the invention and upon reference to the accompanying drawings wherein:

DETAILED DESCRIPTION OF THE PREFERRED EMBODIMENTS

While the invention will be described and disclosed in connection with certain preferred embodiments and procedures, it is not intended to limit the invention to those specific embodiments. Rather it is intended to cover all such alternative embodiments and modifications as fall within the spirit and scope of the invention as defined in the appended claims.

Figure 1:
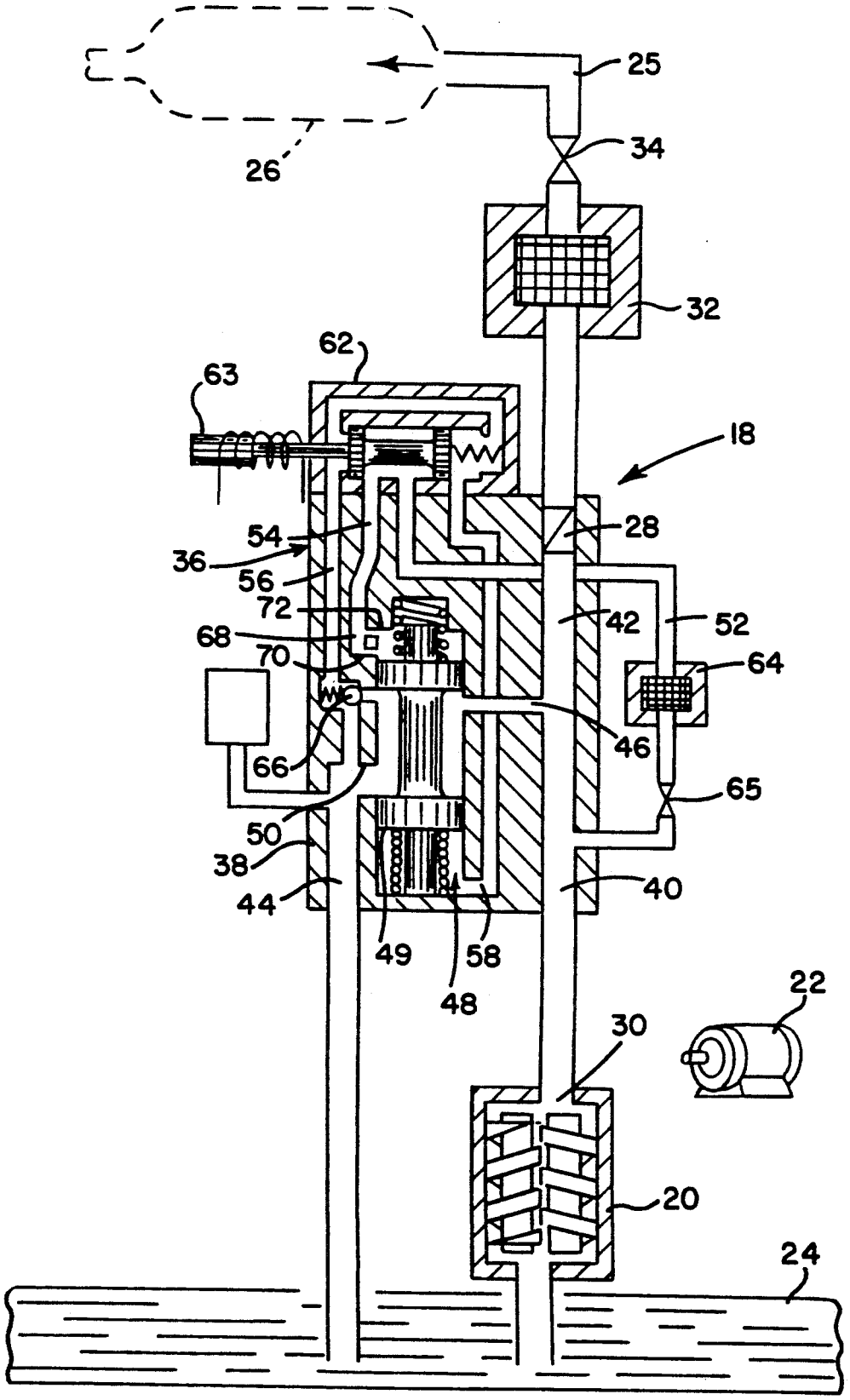
FIG. 1 is a schematic of the hydraulic fluid supply system in an unloaded position, with the directional control valve in the first position.

Turning now to the drawings, FIG. 1 shows a schematic of a hydraulic fluid supply system 18 exemplifying the present invention. It will be appreciated that the supply system 18 shown may be one of a number of such systems in a hydraulic fluid control system. An oil pump 20, which is usually powered by a motor 22, supplies high pressure hydraulic fluid from a fluid supply source, such as a sump 24, to a high pressure outlet 25. The outlet furnishes hydraulic fluid under pressure to a load, such as an accumulator (shown in dotted lines and designated as 26 in FIGS. 1–4). A one-way check valve or spring-loaded poppet valve 28 interposed in the line between the pump 20 and the high pressure outlet 25 insures that fluid flowing from the pump outlet 30 reaches a desired pressure level before flowing to the high pressure load 26. One or more filters 32 may be interposed in the line between the sump 24 and the high pressure load 26 to insure that the hydraulic fluid contains no impurities that would damage the hydraulic system or cause it to malfunction. A valve 34, which is in a normally open position when the particular supply system is in use, disposed between the one-way check valve 28 and the high pressure load 26 may be closed when the particular supply system 1 is not being utilized.

Figure 2:
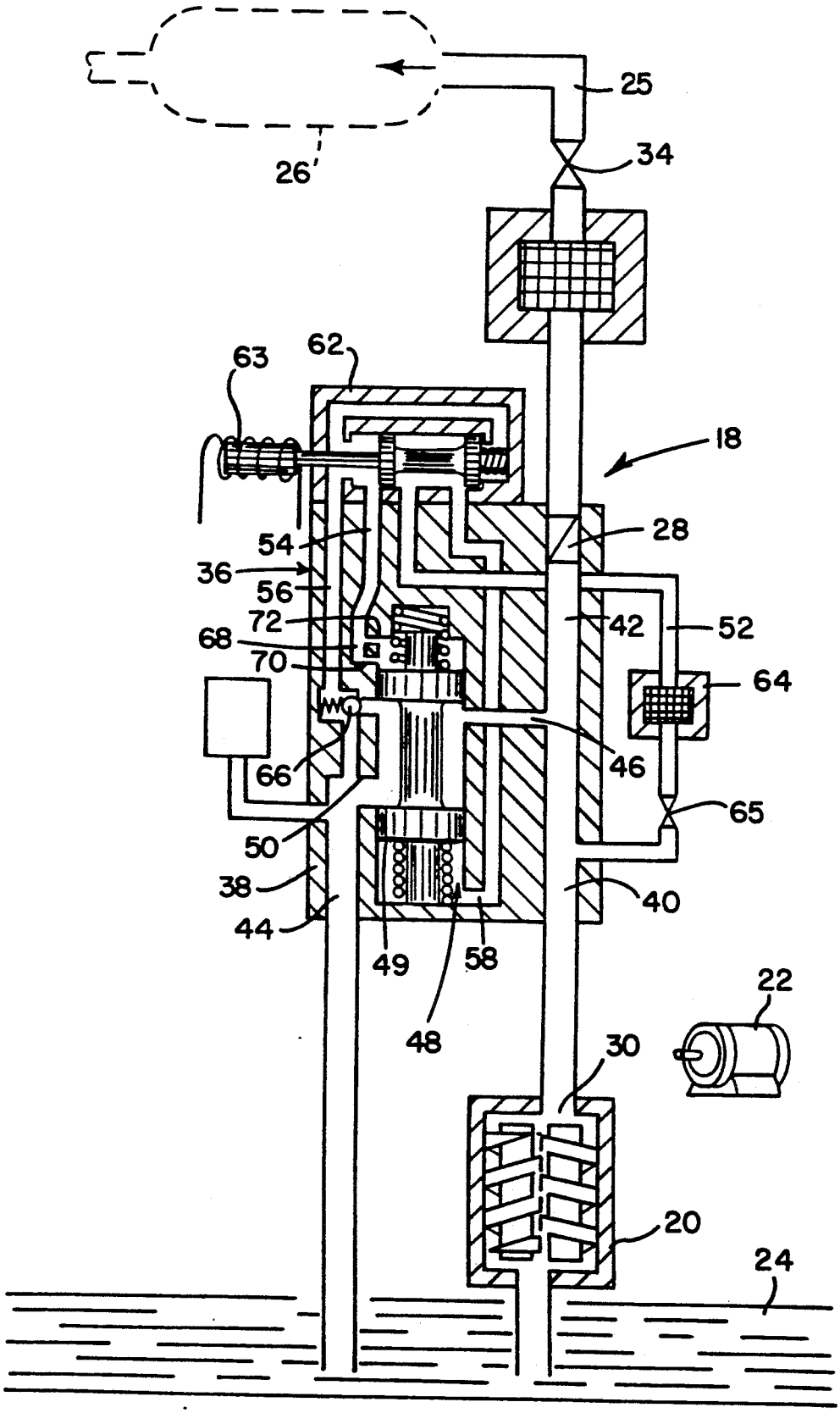
FIG. 2 is the schematic of the system of FIG. 1 in an unloaded position with the directional control valve in the second position.
Figure 3:
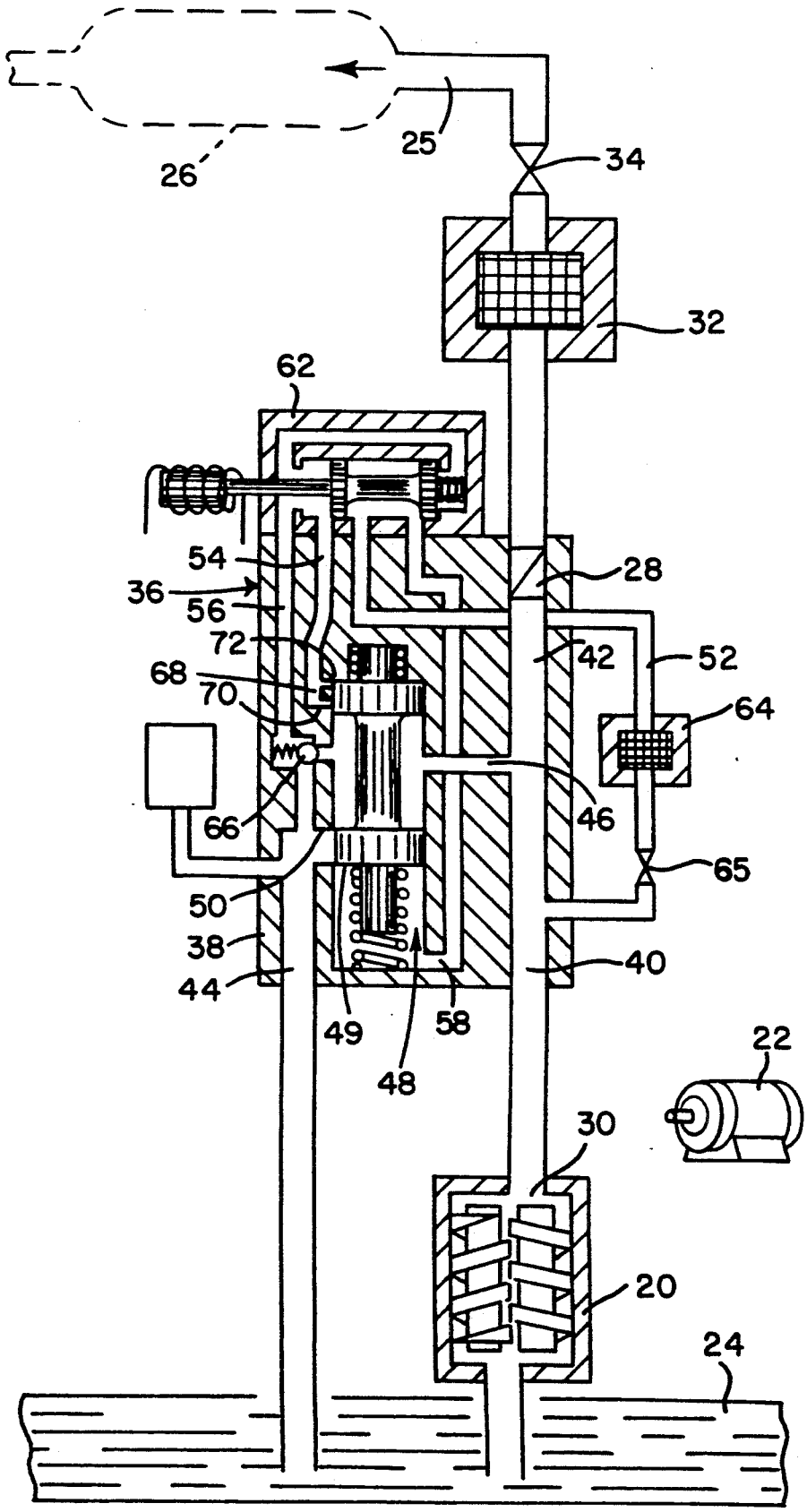
FIG. 3 is the schematic of the system of FIG. 1 in a loaded position with the directional control valve in the second position.
Figure 4:
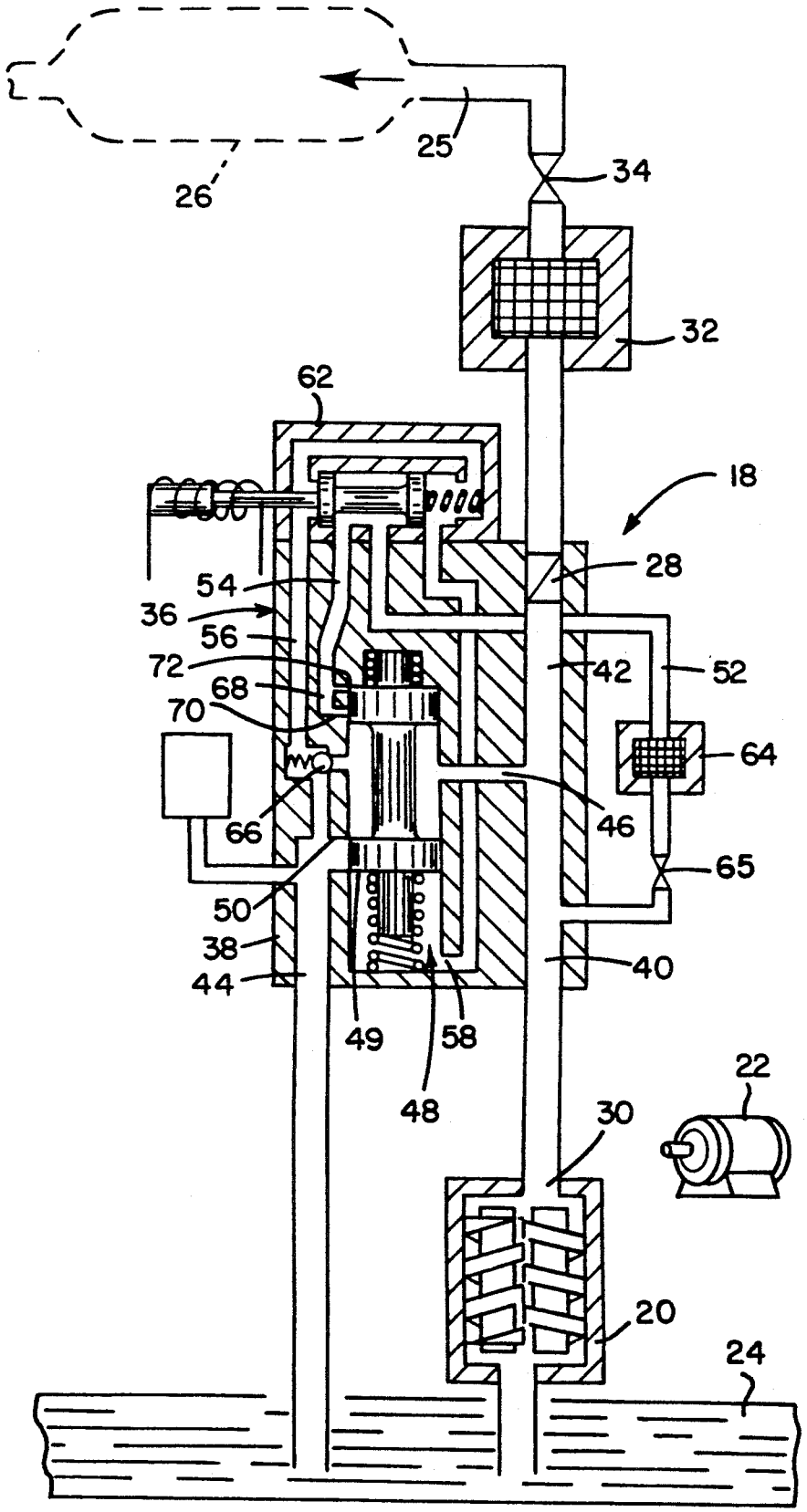
FIG. 4 is the schematic of the system of FIG. 1 in a loaded position with the directional control valve in the first position.

The system 18 may utilize a fixed or variable displacement pump 20 that comes up to speed in a finite time with fluid flow impelled by the pump 20 also increasing during that interval. In the preferred embodiment, a variable displacement pump 20 is utilized. In many cases, it is desirable to limit the load on the pump 20 during this start up interval. In order to allow the pump 20 to come up to speed at a light load before the high pressure load 26 is placed on the system or develop sufficient pressure to supply the high pressure load 26, an unloading valve 36 is interposed between the pump 20 and the load 26. While in this example, the one-way check valve 28 is an integral part of the valve 36, it is not necessarily a requirement of the invention. The valve 36 includes a valve body 38 having an inlet 40, a working outlet 42, and a bypass outlet 44. When the pump 20 is in an unloaded condition, fluid enters the valve 36 through the inlet 40 and exits through the bypass outlet 44. As shown in FIGS. 1 and 2, fluid from the inlet 40 flows through line 46, a valve operator (designated generally as 48), such as a piston type valve having a spool 49, and the bypass outlet 44 to the sump 24. When the pump 20 has developed sufficient pressure, the spool 49 is caused to move axially to close off the bypass port 50 and prevent flow from exiting the valve 36 through the bypass outlet 44, as shown in FIGS. 3 and 4. As a result, flow entering the valve 36 is forced to exit through the working outlet 42 and the one-way check valve 28 to the high pressure outlet 25.

When normal fluid pressure of a desired minimum is re-established in the accumulator or load 26, or it otherwise is desirable to de-energize or unload the pump 20, the spool 49 is caused to slide axially in the opposite direction, moving the valve operator 48 from the loaded condition shown in FIGS. 3 and 4 to the unloaded position shown in FIGS. 1 and 2, once again allowing flow through the valve 36 via the bypass outlet 44 to the sump 24. Once the pump 20 is fully unloaded, the pump motor 22 and pump 20 may be stopped without shock to the system. Alternately, the pump 20 may continue to run to circulate the fluid through the unloader valve 36.

In accordance with the invention, a hydraulic loading system is provided wherein the valve operator is actuated as a result of the flow produced by the pumping system being loaded. Preferably, flow through the unloading valve serves as the activating force for operation of the valve operator. In this way, the valve could be described accurately as a flow loading unloader valve, but for the sake of simplicity, the invention will be disclosed in terms of an unloading valve. The force created due to the flow through the valve to the bypass outlet is derived by a system of passages and controllably applied across the valve operator to move the valve operator from an unloaded to a loaded condition, directing flow to the working outlet. As the flow through the valve in the unloaded condition continues, the operating force, which is applied to the end of the spool, causes the spool to slide axially to the loaded position when the operating force is sufficient to overcome the force at the opposite end of the spool; thus blocking the bypass port so that the fluid flow is directed to the working outlet. According to an additional feature of the invention, the valve may also be designed to unload by appropriately applying the operating force across the valve operator. When the load is to be removed from the system, the operating load is redirected to the opposite end of the valve operator so that the high pressure at the inlet causes the spool to return to its unloaded position such that the flow is re-established through the bypass outlet.

It will be appreciated that the operating force may also be described in terms of pressure created by the flow from the pump. All other forces being substantially equal, when this pressure, which is applied to one end of the valve operator, is greater than the pressure applied to the opposite end of the valve operator, the valve will move from either the unloaded to the loaded condition, or the loaded to the unloaded condition. While the invention may be described in terms of pressure, it will be appreciated that the invention could likewise be described in terms of forces applied to the valve operator.

As shown in FIG. 1, the flow progresses from the inlet 40, through the valve operator 48 to the bypass outlet 44. The resulting flow pressure is communicated to one end of the valve spool 49 by lines 52 and 54. The opposite end of the spool 49 communicates with the bypass outlet 44 through lines 56 and 58. In order to provide a flow connection between the lines 52, 54, 56, 58, a directional control valve 62 is provided. In the embodiment exemplified in FIGS. 1–4, a solenoid operated four-way valve 62 is utilized to direct the flow to the ends of the valve operator 48. As shown in FIG. 1, the solenoid operated valve 62 is in its de-energized position, directing pressure from the inlet 40 through the lines 52 and 54 to the upper end of the spool 49, and also connecting an outlet path from the bypass outlet 44 through the lines 56 and 58 to the lower end of the spool 49. In order to prevent impurities in the fluid exiting the pump 20 from interfering with the smooth operation of the directional control valve 62 and the valve operator 48, a filter 64 is interposed in line 52. Line 52 is also provided with a valve 65 that is normally set in the open position. Although the invention is described in terms of pressures at the inlet 40 and the bypass outlet 44 (i.e., a double-acting arrangement), alternate arrangements are contemplated. For example, the pressure created at the inlet 40 could be directed to one end of the valve operator 48, and the opposite end could be connected directly to a drain, such as with a single-acting operator or the like.

While the invention will generally be described with reference to cyclic operation of the loading system 18, it will be appreciated that the valve 36 can likewise operate in a continuous mode, continuously circulating the fluid through the unloading valve 36. During operation in the cyclic mode, when automatic controls (not shown) sense a low pressure condition in the accumulator tank 26, the controls begin the pumping cycle by energizing the motor 22, which rotates the pump 20 to begin pumping fluid from the sump 24 to the unloading valve 36. The electrical solenoid valve 62 is likewise energized to move the valve 62 to its alternate condition, as shown in FIG. 2. It will be appreciated that circuitry may be provided to energize the solenoid valve 62 at approximately the same time as power is supplied to the pump 20. In this way, the solenoid valve 62 connects the bypass outlet 44 to the upper end of spool 49 by way of lines 56 and 54, and connects the valve inlet 40, and, therefore, the pump outlet 30 to the lower end of the spool 49 by way of lines 52 and 58.

Figure 5:
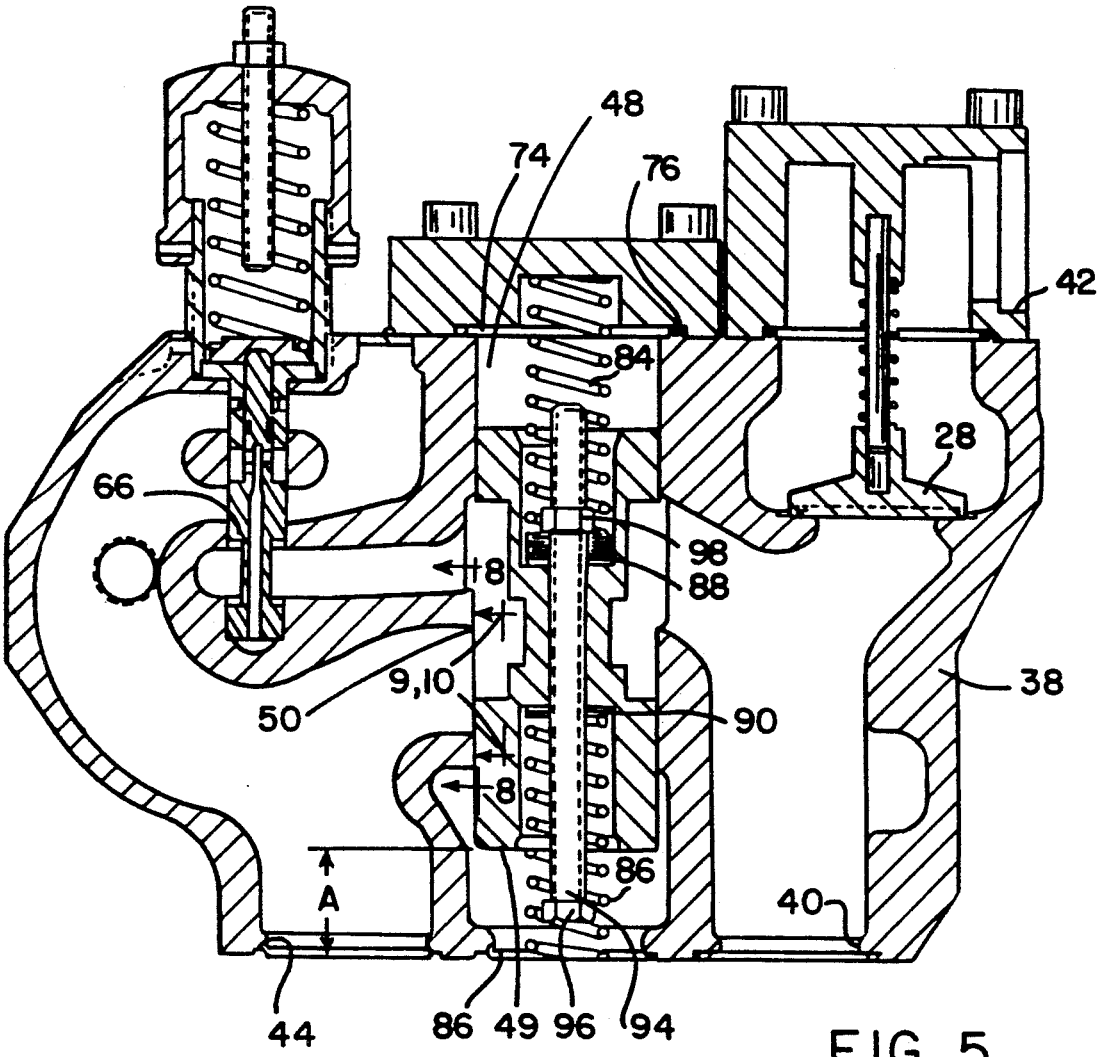
FIG. 5 is a cross-sectional view of the unloading valve of the invention.

It will further be appreciated that while the spool 49 travels through a range of positions during operation, it has three equilibrium positions, as illustrated in FIGS. 1–5. The spool 49 may be stationary when it is in its extreme downward position, as shown in FIGS. 1 and 2, when it is in its extreme upward, loaded position, as shown in FIGS. 3 and 4, or when it is in its "spring-biased" position, as shown in FIG. 5. In the broadest sense, both of the positions shown in FIGS. 1, 2, and 5, wherein the bypass port 50 is at least partially open, may be considered unloaded. When the motor 22 first is energized, the spool 49 will be in a spring-biased quiescent condition (as shown in the cross-sectional view of the valve 36 in FIG. 5), allowing fluid flow to the bypass outlet 44. Alternately, if the pump 20 is running in a continuous mode, the spool 49 will be disposed at a downward position, as shown in FIG. 1, where the solenoid directed valve 62 is in its de-energized position, directing inlet 40 pressure to the top of the spool 49. As a result, a very light load is placed on the pump 20 when it is running in its continuous mode.

If while the pump 20 is running in a continuous and unloaded condition, a signal is given to energize the solenoid of the directional control valve 62, the pressure at the inlet 40 is redirected from the top to the bottom of the spool 49. As a result, the spool 49 begins to rise, closing off the bypass port 50. As the open area of port 50 becomes progressively restrictive, the pressure at the inlet 40 increases, which increases the operating force applied to the valve operator 48. As the spool 49 progresses toward its extreme upward position, sufficient pressure is developed within the valve 36 to begin opening the one-way check valve 28 to provide flow through the working outlet 42. As the port 50 becomes progressively restrictive and eventually fully closes off bypass flow, the one-way check valve 28 fully opens to allow full fluid flow to pass through the working outlet 42 to the load or accumulator 26, as shown in FIG. 3.

When flow to the high pressure load 26 is no longer required, as when normal pressure or a desired minimum is re-established in the accumulator tank, a signal is provided to de-energize the solenoid operated valve 62 to restore it to the position shown in FIG. 4. Returning the directional valve 62 to its original position once again connects the valve inlet 40, and, therefore, the pump outlet 30, to the upper end of the spool 49 by way of lines 52 and 54, and further connects the bypass outlet 44, and, therefore, the sump 24, to the lower end of the spool 49 by way of lines 56 and 58. Consequently, the pressure is applied to the spool 49 ends such that the high pressure fluid from the pump outlet 30 flowing through the valve inlet 40 causes the valve operator 48 to return to the unloaded condition shown in FIG. 1. The resultant flow through the valve 36 to return to the bypass outlet 44, significantly reduces the load on the pump 20. When the piston 48 is in the fully unloaded position, the load on the pump 20 is greatly reduced and the motor 22 can be stopped to shut down the pump 20. Alternately, in a continuous flow system the pump 20 can continue to run at a light load until it is indicated that another cycle is required.

A cross-sectional view of the unloading valve 36 is shown in more detail in FIG. 5 wherein the components of the valve 36 correspond to those discussed above with reference 58 that apply the pressure or operating force across the valve operator 48 are not illustrated in FIG. 5, those connections would be the same as in the schematics of FIGS. 1 through 4. The spool 49 is shown in a spring-biased quiescent position, as when there is no flow through the loading valve 36, as before the start of a pumping cycle. When the pumping cycle is initiated and as the pump 20 comes up to speed, the spool 49 rises to block the bypass port 50 to prevent flow to the bypass outlet 44. As a result, the fluid flows through the working outlet 42 to the high pressure load 26 (not shown in FIG. 5). When the solenoid operated valve 62 (not shown in FIG. 5) reverses the pressure or operating force across the valve operator 48, the spool 49 moves downward to again allow flow to the bypass outlet 44, which reduces the load on the pump 20 so that it may be de-energized.

In accomplishing an important aspect of the invention, the unloading valve 36 allows smooth transitional loading and unloading by providing smooth, shock-free action during operation. One feature that contributes to the safe operation of the unloading valve 36 is a relief valve 66 provided along the outlet side of the valve operator 48. While the relief valve 66 may be set to allow fluid passage at any appropriate pressure, in a preferred embodiment of the invention, the pressure at which the relief valve 66 allows fluid passage may be set in a range between around 200 to 1650 psi. In one unit embodying the invention, the relief valve 66 pressure was preset at 590 psi.

During operation, as the pressure or operating force applied across the valve operator 48 causes the spool 49 to rise, the spool 49 progressively blocks the bypass flow path through the bypass port 50. As a result, the pressure of the fluid in the valve 36, and, likewise, the differential pressure across the valve 36, increases rapidly as the opening of the bypass port 50 gets progressively smaller. If for some reason the pump outlet pressure rises to a level that is higher than normal (for example, if the valve 34 were inadvertently left closed), and then the valve 36 was loaded, the relief valve 66 would open at a safe level, by passing the fluid to the outlet passage 44. It will be appreciated that the relief valve 66 will continue to allow the passage of fluid to the bypass outlet after the bypass port 50 has been completely blocked by the piston 48, so long as the pressure differential exceeds the preset level of the relief valve 66. In this way, the relief valve 66 provides a safety feature by preventing pressure within the valve 36 from exceeding desired operating levels.

Figure 6:
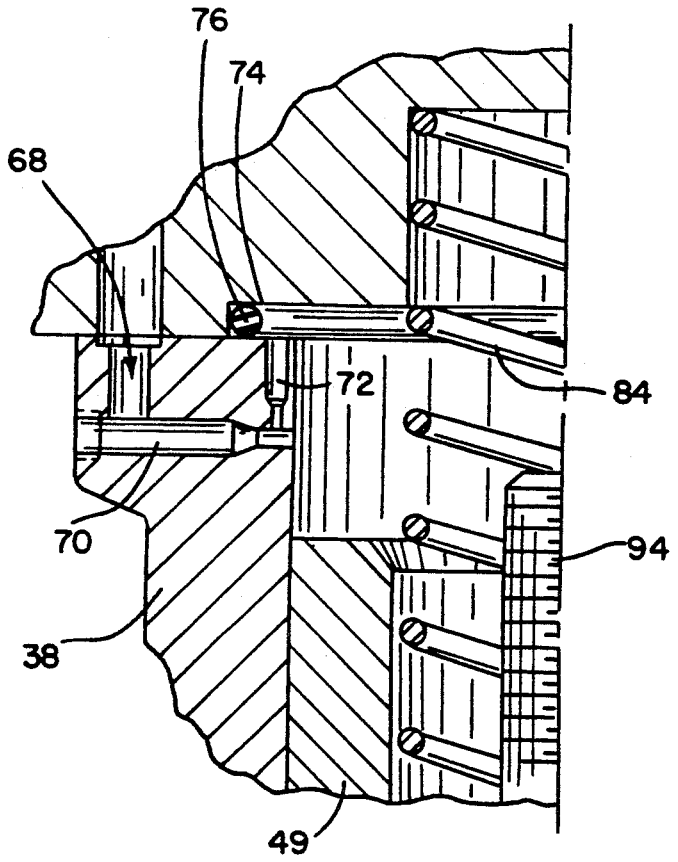
FIG. 6 is an enlarged, fragmentary, cross-sectional view of the orifice assembly that provides piston damping.

One skilled in the art will appreciate that, during operation, if the fluid contained in the chambers at the ends of the valve operator 48 was permitted to flow without any restriction to the sump 24 as the spool 49 moved from the unloaded to the loaded position or from the loaded to the unloaded position, the spool 49 would move very rapidly, resulting in a shock to the system 18 and rough transitional loading and unloading. To prevent this rapid, unrestricted movement of the spool 49, an orifice assembly 68 is provided. While it will be appreciated that such assemblies could be provided to restrict the flow to and from either or both the chambers at the upper and lower ends of the valve operator 48, in a preferred embodiment of the invention, an orifice assembly 68 is disposed to control the flow of fluid to and from the upper end of the valve operator 48 as directed by the solenoid operated directional valve 62. As shown in the schematic views of FIGS. 1–4 and the cross-sectional view of FIG. 6, the orifice assembly 68 includes a first relatively large orifice 70 and a second relatively small orifice 72 to control the rate at which fluid flows from or is supplied to the upper end of the valve operator 48. While the orifice assembly 68 is not shown in FIG. 5, it will be appreciated that the assembly 68 is disposed to regulate flow to and from the chamber at the upper end of the valve operator 48. In a preferred embodiment of the invention, the orifice assembly 68 lies in a plane approximately 30° from the front plane of the cross-sectional view shown in FIG. 5, although the orifice assembly 68 may be disposed at any appropriate angle to facilitate the required hydraulic connections. In the embodiment shown, the small orifice 72 is disposed such that it opens at one end into the lip 74 in the valve body 38 in which an o-ring 76 is seated and at the other end to the large orifice 70, although the small orifice 72 could likewise be disposed parallel to the large orifice 70, opening into the line 54 as shown schematically in FIGS. 1–4. The large orifice 70 provides flow from the chamber above the valve operator 48 directly to the line 54.

During operation, as the spool 49 moves from the unloaded to the loaded position, fluid flows out of the chamber above the valve operator 48 substantially through the large orifice 70 to line 54 to the directional valve 62 and on to the sump 24. As the spool 49 moves upward in the chamber, it eventually blocks the opening of the large orifice 70 to prevent flow therethrough. As a result, the additional fluid displaced by the rising spool 49 must flow through the small orifice 72. In this way, the orifice assembly 68 functions similar to a shock absorber to prevent rapid movement of the spool 49. In the preferred embodiment, the spool 49 moves about one third of its travel distance before closing off the large orifice 70 opening. It will be appreciated that as the initial flow through the large orifice 70 provides fast initial spool 49 movement. Once the large orifice 70 is blocked, the small orifice 72 regulates flow to provide a significantly greater flow restriction, slowing spool 49 movement during its final loading. Consequently, the orifice assembly 68 provides smooth loading and unloading of the valve 36 by a damping feature.

Figures 7, 11:
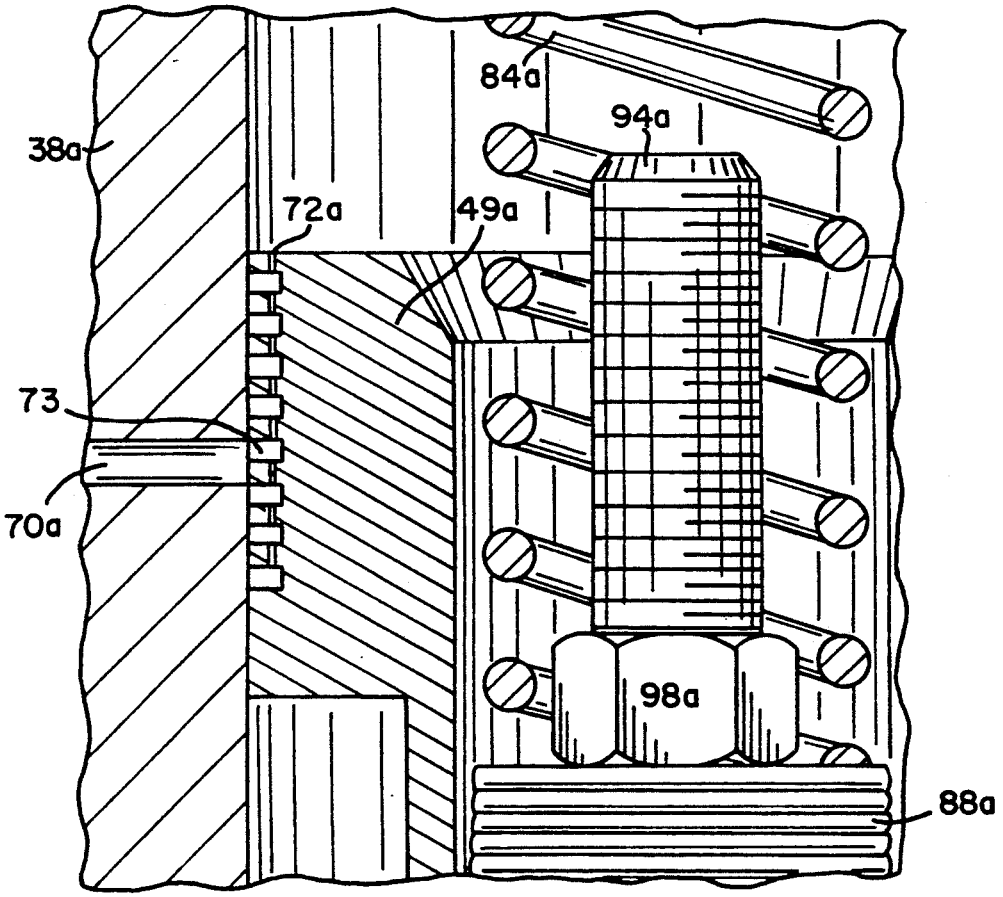
FIG. 7 is an enlarged, fragmentary, cross-sectional view of an alternate design for providing piston damping.
FIG. 11 is a chart of flow related settings for set up of the unloading valve.

It will be appreciated that an alternate design, such as the orifice **70*a* and valve operator 48*a* design shown in FIG. 7, may likewise provide multi-stage damping movement of the spool 49*a*. Similar to the embodiment shown in FIG. 6, substantial flow of fluid to and from the chamber at the upper end of the valve operator 48*a* is provided by a slower, more controlled flow of fluid and movement of the spool 49*a* is provided by a series of smaller orifices 72*a* and grooves 73 provided in the spool 49*a*. These smaller orifices 72*a* and grooves 73 provide additional damping during the final movement of the spool 49*a*. In a manner similar to that described above, as the spool 49*a* travels past the large orifice 70*a*, further escape of fluid from the chamber at the upper end of the valve operator 48*a* is provided by the smaller orifices 72*a* and grooves 73. In order to provide a fluid path to allow flow until the spool 49*a* reaches its most extreme position, at least a portion of the grooves are open to the large orifice 70*a* as the spool 49*a* continues to travel, as shown in FIG. 7. It will be appreciated that travel in the opposite direction is likewise controlled by flow toward the upper end of the valve operator 48*a* through the large orifice 70*a*, the small orifices 72*a*, and the grooves 73. In this way, the multi-stage flow of fluid to and from the valve operator 48*a* provides smooth loading and unloading of the valve 36**.

In a currently preferred embodiment of the invention, the difference in pressure across the valve operator 48, or differential pressure, at which the spool 49 begins to move is 50 psi, although the valve may be adjusted to provide movement at an alternate pressure. This differential pressure is dependant upon the flow rate from the pump 20, as well as the area of the open portion of the bypass port 50. When the spool 49 is in its quiescent, spring-biased position, as shown in FIG. 5, the lowermost portion of the port 50 is closed off by the spool 49, and, therefore, is not open to fluid flow. It is the area of the open portion of the port 50 the flow through the valve 36, and the centering forces exerted on the spool 49 when it is in its spring-biased position that determines the differential pressure at which the spool 49 begins to move. The differential pressure is determined by solving for $\Delta P$ in the following equation, wherein $\Delta P$ is the differential pressure in pounds per square inch (lbs/in$^2$), Q is the flow rate from the pump 20 in cubic inches per second (in$^3$/sec), A is the area of the open portion of the port 50 in square inches (in$^2$) and C is a constant flow related coefficient that is experimentally determined and is dependent upon the dimensions of the valve 36 and the unloading port 50, among other things:

$$Q = CA\sqrt{\Delta P}$$

Flow in gallons per minute, or gpm, can be converted to in$^3$/sec according to the following conversion formula:

$$\left(\frac{\text{gal}}{\text{min}}\right)\left(\frac{231\ \text{in}^3/\text{gal}}{60\ \text{sec/min}}\right) = (\text{in}^3/\text{sec})$$

In the preferred embodiment of the invention shown in FIGS. 1–9, the value of the constant C is 100. Thus, for example, when the differential pressure at which the valve operator 48 is set to operate is 50 psi, and the open area of the port 50 is approximately 2.18 in$^2$, the spool 49 will begin to move immediately when the pump 20 is energized to produce a flow of 400 gpm.

According to another important feature of the invention, the unloading valve 36 may be adjusted to accommodate a wide range of flow capacities and pressures, and still provide movement of the spool 49 at the requisite 50 psi differential pressure, or at a different pressure for a different flow rate if so desired. In a preferred embodiment of the invention, the flow capacity for the valve 36 is the range between 10 gallons per minute and 400 gallons per minute. In short, the same valve 36 can be configured to be fully functional in a small system where design flow rates are only 10 gpm, or in a substantially larger system where flow rates of 400 gpm are accommodated. Likewise, the valve 36 can accommodate a corresponding wide range of pressures. The valve 36 can accommodate pressures ranging from about 150 psi to 1100 psi, or, in some cases, as high as 1650 psi. In accomplishing these features such that a single valve 36 may be configured to operate over a range of pressures and flow rates, no major mechanical changes in the valve body 38 itself as well as changes in various components utilized in the valve 36 are required. Rather, in order to configure a valve 36 that operates over a particular range of flow rates or pressures, the valve 36 has a number of possible initial setups. Inasmuch as this is a substantial flow range for the operation of a device of a single design, it will be appreciated that manufacturing, servicing and stocking of parts of the valve is greatly simplified in that a single valve body 38 and other related components may be utilized in a number of applications.

In order to adapt the valve 36 of the invention for different flow rates, the valve 36 may be set up so that the open area of the port 50 is of the appropriate size, as determined by solving for A in the above equation, to result in spool 49 movement at 50 psi or other desired differential pressure for a given flow rate. In accomplishing this objective, the invention provides a particularly shaped port 50 design as well as means to adjust the extent to which the bypass port 50 will open during maximum flow through the unloading valve 36.

Figure 8:
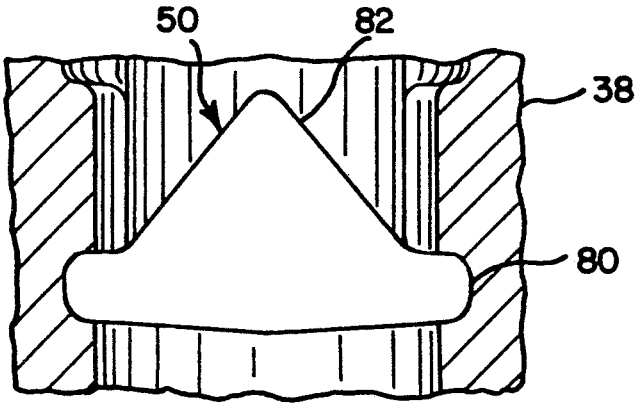
FIG. 8 is fragmentary view of the bypass port taken along line 8—8 in FIG. 5.

Turning first to the design of the bypass port 50, the port 50 has a shape that is particularly suited for passing a range of flows. The bypass port 50, which is shown in FIG. 8 has a large, substantially rectangular-shaped lower portion 80, and a substantially triangular-shaped upper portion 82. It will be appreciated that the level of fluid flow from the pump 20, along with the differential pressure desired will determine how much of the port 50 will open to bypass flow when the piston 48 is in the spring-biased position. For example, at high flow levels, substantial fluid flow will be provided through both the large lower portion 80 and the shaped upper portion 82. As the differential pressure across the valve 36 reaches a sufficient level to cause the spool 49 to move from the unloaded position, the moving spool 49 will progressively block first the lower portion 80, and then the upper shaped portion 82. As the spool 49 rises, the pressure of the fluid flowing through the valve 36 increases significantly to further close off the flow passage. In this way, the design of the bypass port 50 provides smooth, shock-free transitional loading and unloading operations. It will be appreciated that this particular port 50 shape is given by way of example, and that the port 50 may be of an alternate shape that likewise provides smooth transitional loading and unloading.

The distance that the unloader spool 49 is permitted to travel is limited by a system of centering springs 84, 86 and spacers 88, 90. Thus, in order to vary the area of the bypass port 50 that is open to fluid flow at pump 20 start up, the number of spacers, in this embodiment washers 88, 90 are used, and the spring 84, 86 biased gap A may be adjusted at initial setup of the valve 36. In this way, the initial, adjustable start-up differential pressure for a given flow rate is determined by the set up of the springs 84, 86 and washers 88, 90. As previously stated, a differential pressure of approximately 50 psi provides for fast initial loading action from a pump 20 unloaded condition, although it will be appreciated that the valve 36 may be set up to operate at an alternate differential pressure as desired.

Figure 9:
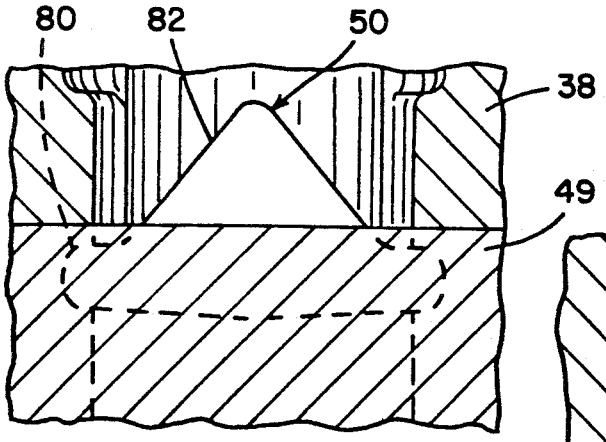
FIG. 9 is a fragmentary view of the unloading valve taken along line 9—9 in FIG. 5, wherein the valve is set up for relatively low flow rates.
Figure 10:
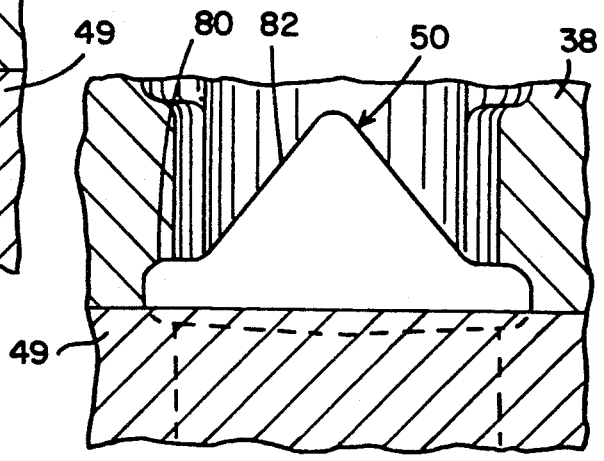
FIG. 10 is a fragmentary view of the unloading valve taken along line 10—10 in FIG. 5, wherein the valve is set up for relatively high flow rates.

It will be appreciated that the adjustability of the unloader valve operator spool 49 biasing along with the particular shape of the bypass port 50 combine to provide a valve 36 that will operate over a wide flow range and pressure range. As shown in FIGS. 9 and 10 and as indicated above, the range of flow rates may be adjusted by the extent to which the bypass port 50 is uncovered by the spool 49. At low flow rates, the unloader valve operator spool 49 may be set up to close off all of the large rectangular portion 80 of the bypass port 50, as shown in FIG. 9. In this way, the bypass flow is restricted to the triangular portion 82 of the port 50, which will generate the requisite pressure drop across the unloader valve operator 48 at a low flow rate. At higher flow rates, the spool 49 may be set up to allow the opening of a large portion of the rectangular-shaped port 80 as shown in FIG. 10. This allows a higher bypass flow rate to generate the same pressure drop across the valve 36.

A chart of representative flow related settings for the setup of the valve 36 in a preferred embodiment are shown in the chart identified as FIG. 11. It will be appreciated that the values given are by way of representation and not limitation. As shown in the chart, for a given flow rate in gallons per minute (gpm), a specified number of washers 88, 90 may be assembled with the unloader piston to achieve the specified gap identified as A in FIG. 5. Gap A represents the distance between the lower surface of the unloader valve operator spool 49 in its quiescent spring-biased position and a reference point, which is the lower surface of the valve body 38 in this embodiment. As shown in the chart of the FIG. 11, for low flow rate, such as 10–50 gallons per minute, the gap A is relatively large. Consequently, a majority of the large rectangular portion 80 of the bypass port is closed off by the spool 49 such that the flow through the bypass outlet 44 is restricted primarily to the triangular portion 82, as described above and shown in FIG. 9. Returning now to the chart of FIG. 11, it will be appreciated that the gap A is reduced at higher flow rates. This results in a larger opening of the rectangular-shaped portion 80 of the bypass port 50, as shown in FIG. 10 and explained above, allowing a higher bypass flow rate through the bypass outlet 44 for a given pressure drop across the port 50. Thus, valve 36 may be set up to provide a desired differential pressure across the valve 36 for either high or low flow rates, as shown in the chart. Each of the representative flow related setups shown in FIG. 11 will provide a 50 psi differential pressure for the given flow rates.

In accordance with another aspect of the invention, the valve 36 may be adjusted to provide a second differential pressure by adjusting a stop to establish a minimum lower position for the unloader valve operator spool 49 when the valve 36 is operating in an unloaded condition. This stop includes a threaded rod 94, which extends through the spool 49. The lower bolt head 96 on the threaded rod 94 may be rotated to thread the rod 94 through the spool 49 and the upper bolt 98. During operation, the downward movement of the spool 49 will be limited when the lower bolt head 96 and the threaded rod 94 reach the base plate 86 of the valve 36, as shown in FIG. 5. This second differential pressure is especially useful to avoid oil heating problems when the pump 20 is being run continuously, for example in flow ranges of 10–400 gallons per minute. In this way, a low but controlled pressure drop may be established across the valve 36 when the pump 20 is running substantially unloaded during much of a continuous operating mode. Operation of the valve 36 using this second differential pressure as a temperature and viscosity control device is disclosed in more detail in the copending application Ser. No. 602,712 filed Oct. 21, 1990.

In summary, the invention provides an unloading valve 36 that is interposed between the pump 20 and a high pressure load 26. The valve controllably imposes a hydraulic load on the pump 20 at start up and releases the load before the pump 20 shuts down at the end of a cycle. The valve 36 includes an inlet 40, a working outlet 42, a bypass outlet 44, and a valve operator 48, which controls the direction of flow through the valve 36. The movement of the valve operator spool 49, which is interposed between the inlet 40 and the bypass outlet 44, is achieved by applying the differential pressure created across the valve 36 to the spool 49. In this way, the spool 49 moves from an unloaded to a loaded position, shutting off flow through the bypass port 50 to the bypass outlet 44, as the differential pressure increases as a result of the progressive flow restriction through port 50. At the end of the cycle, the application of the differential pressure to the valve operator 48 is reversed to return the spool 49 to its unloaded position. The valve 36 is suitable for a wide range of flow rates and pressures, and may be adjusted to provide a desired pressure differential across the valve 36 by adjusting the degree to which the valve operator 48 allows flow through the bypass port 50 when the valve 36 is in the unloaded condition. This is accomplished by varying the initial setup using washers 88, 90 and centering springs 84, 86, and after the initial setup by adjusting the threaded rod 94, which serves as the stop for the spool 49. In the preferred embodiment of the invention, the valve 36 further includes a pressure relief valve 66, which operates to prevent an over pressure situation. Thus, the invention provides a valve 36 having hydraulic connections to only the sump 24, the high pressure load 26, and a source of fluid, such as the pump 20, wherein the valve 36 may be operated in both cyclic and continuous modes, and further prevents a situation in which there is excessive pressure build up in the system 18.

I claim as my invention:

1. A flow loading unloader valve for use in a high pressure hydraulic system which includes a fluid supply a pump, and a high pressure load, the flow loading unloader valve being interposed between the pump and the load to controllably impose the load on the pump, the flow loading unloader valve using common and variable elements to meet a variety of flow and pressure conditions, the common elements comprising: a body having an inlet, a work outlet, a bypass outlet, a shaped bypass port disposed between the inlet and the bypass outlet, a valve operator disposed within the body to regulate flow therethrough, and means responsive to a valve operator operating force resulting from flow through the bypass port of the valve for smoothly transferring the valve operator as flow through the bypass port increases from an unloaded position in which fluid flow from the inlet is ported to the bypass outlet, to a loaded position in which fluid flow from the inlet is directed to the working outlet;

the variable elements comprising: means for setting the extent to which the shaped bypass port will open to allow fluid flow from the inlet to the bypass outlet when the valve operator is in the unloaded position, such that the valve accommodates relatively high design flow rates and desired pressure conditions when the bypass port has a substantially large opening and relatively low design flow rates and desired pressure conditions when the bypass port has a substantially small opening, the means for adjusting the extent to which the shaped bypass port will open including spacers disposed in line with the valve operator and coupled thereto and springs disposed to establish the unloaded position of the valve operator and the extent to which the shaped port is open to flow.

2. A flow loading unloader valve as claimed in claim 1 wherein the pressure conditions associated with the relatively high design flow rates include a pressure drop across the valve at a desired level, and the pressure conditions associated with the relatively low design flow rates include a pressure drop across the valve of approximately the same desired level.

3. A flow loading unloader valve as claimed in claim 1 wherein the means for adjusting the extent to which the shaped bypass port will open includes an adjustable stop that limits valve operator travel from the loaded position to the unloaded position.

4. A flow loading unloader valve as claimed in claim 1 wherein the spacers and springs determine the extent to which the shaped bypass port is open to flow when flow through the valve is initiated to define a first pressure differential across the valve operator, and the means for adjusting the extent to which the shaped bypass port will open further comprises an adjustable stop that limits travel of the valve operator from the loaded position to define a second pressure differential across the valve operator.

5. A flow loading unloader valve interposed between a fluid supply and a load, comprising:

a valve body having an inlet, a working outlet, and a bypass outlet, a bypass port interposed between the inlet and the bypass outlet, the bypass port being generally triangularly shaped, a valve operator for controlling the degree of opening of the bypass port and having an unloaded position in which fluid flow from the inlet is ported to the bypass outlet, and a loaded position in which fluid flow from the inlet is directed to the working outlet, the width of the bypass port increasing from one end to the other as the valve operator moves to the unloaded position, means for deriving a valve operator operating force from flow through the valve, and means coupling the valve operator operating force to the valve operator for transferring the valve operator from an initial position to alternate position.

6. A flow loading unloader valve as claimed in claim 5 wherein the shaped port further includes a substantially enlarged shape at the base of the triangular shaped portion of the port.

7. A flow loading unloader valve interposed between a fluid supply and a load, comprising:

a valve body having an inlet, a working outlet, and a bypass outlet, a bypass port interposed between the inlet and the bypass outlet, the bypass port being generally shaped so that the width of the port increases from one end to the other, a valve operator for controlling the degree of opening of the bypass port and having an unloaded position in which fluid flow from the inlet is ported to the bypass outlet, and a loaded position in which fluid flow from the inlet is directed to the working outlet, the width of the bypass port increasing from one end to the other as the valve operator moves to the unloaded position, said valve operator including a spool, means for deriving a valve operator operating force from flow through the valve, means coupling the valve operator operating force to the valve operator for transferring the valve operator from an initial position to alternate position, means for adjusting the unloaded position of the valve operator and the distance that the valve operator is permitted to transfer, wherein the unloaded position of the valve operator determines the extent to which the bypass port will open, the adjusting means including a threaded rod extending through the spool which functions as a stop and limits the distance that the spool can move in the unloaded position, the adjusting means further including spacers and springs disposed in line with the valve operator, wherein the valve operator may be set up to attain a first differential pressure across the valve operator by adjusting the spacers and the springs disposed in line with the valve operator, and the valve operator may be set up to attain a second differential pressure across the valve operator by adjusting the threaded rod, and a relief valve preset to prevent an over-pressure condition.

8. A flow loading unloader valve interposed between a fluid supply and a load, comprising:

a valve body having an inlet, a working outlet, and a bypass outlet, a bypass port interposed between the inlet and the bypass outlet, a valve operator for controlling the degree of opening of the bypass port and having an unloaded position in which fluid flow from the inlet is ported to the bypass outlet, and a loaded position in which fluid flow from the inlet is directed to the working outlet, means for deriving a valve operator operating force from flow through the valve, means coupling the valve operator operating force to the valve operator for transferring the valve operator from an initial position to alternate position, the transferring means comprising a fluid flow connection from the inlet to an end of the valve operator, and a multi-stage orifice means that controls fluid flow to and from the end of the valve operator, and passage means for deriving the valve operator operating force from a pressure drop across the valve due to flow through the valve.

9. A flow loading unloader valve as claimed in claim 8 wherein the transferring means include a directional control valve.

10. A flow loading unloader valve as claimed in claim 8 wherein the bypass port is generally shaped so that the width of the port increases from one end to the other as the valve operator moves to the unloaded position.

11. A flow loading unloader valve as claimed in claim 7 further comprising means for adjusting the unloaded position of the valve operator and the distance that the valve operator is permitted to transfer, wherein the unloaded position of the valve operator determines the extent to which the bypass port will open to determine a pressure drop across the bypass port in the unloaded condition.

12. A flow loading unloader valve as claimed in claim 8 wherein the bypass port is substantially open when the valve operator is adjusted for high flow rates and the bypass port is limited to a substantially smaller opening for lower flow rates.

13. A flow loading unloader valve as claimed in claim 11 wherein the bypass port is generally shaped so that the width of the port increases from one end to the other as the valve operator moves to the unloaded position, and the means to adjust the unloaded position of the valve operator and the extent to which the bypass port will open include spacers interposed in line with the valve operator.

14. A flow loading unloader valve as claimed in claim 11 wherein the bypass port is generally shaped so that the width of the port increases from one end to the other as the valve operator moves to the unloaded position, and the valve operator includes a spool, and the means to adjust the unloaded position of the spool and the size of the opening of the bypass port include a threaded rod extending through the spool which functions as a stop and limits the distance that the spool can move in the unloaded position.

15. A flow loading unloader valve as claimed in claim 8 wherein the multi-stage orifice means comprises a substantially large orifice for controlling initial flow to and from the valve operator and a substantially smaller orifice for controlling fluid flow to the valve operator during a final stage of movement of the valve operator.

16. A flow loading unloader valve as claimed in claim 15 wherein the small orifice is disposed in the valve operator and the large orifice is disposed in the valve body.

17. A flow loading unloader valve as claimed in claim 8 further comprising a relief valve preset to prevent an over-pressure condition within the valve.

18. A flow loading unloader valve as claimed in claim 8 wherein the means coupling the valve operator operating force to the valve operator for transferring the valve operator transfers the valve operator from the alternate position to the initial position.

19. A flow loading unloader valve as claimed in claim 18 wherein the transferring means comprises a directional control valve.

20. A method of operating a flow loading unloader valve within a high pressure hydraulic system which includes a fluid source, a hydraulic pump, and a high pressure load, the flow loading unloader valve being interposed between the pump and the load, the flow loading unloader valve having an inlet, a working outlet, a bypass outlet, and a valve operator to smoothly load the hydraulic pump, the method comprising the steps of:

pumping fluid from the fluid source through the valve inlet and a bypass port to the bypass outlet when the valve operator is in an unloaded position, deriving a valve operator operating force resulting from flow through the bypass port of the valve, coupling the valve operator operating force derived from flow through the bypass port to the valve operator and activating or deactivating a solenoid-operated directional control valve to smoothly transfer the valve operator from the unloaded position in which the bypass port is open to a loaded position in which the bypass port is closed and fluid flows from the inlet to the working outlet, and unloading the hydraulic pump by transferring the valve operator from the loaded to the unloaded position in which fluid flows to the bypass outlet.

21. A method as claimed in claim 20 wherein the operating force is derived from a pressure drop across the bypass port.

22. A method as claimed in claim 21 wherein the valve operator moves from the unloaded to the loaded position when the pressure drop across the bypass port is on the order of 50 psi.

23. A method of operating a flow loading unloader valve within a high pressure hydraulic system which includes a fluid source, a hydraulic pump, and a high pressure load, the flow loading unloader valve being interposed between the pump and the load, the flow loading unloader valve having an inlet, a working outlet, a bypass outlet, a valve operator to smoothly load the hydraulic pump, and means to adjust the unloaded position of the valve operator and the distance that the valve operator is permitted to move axially, the method comprising the steps of:

pumping fluid from the fluid source through the valve inlet and a bypass port to the bypass outlet when the valve operator is in an unloaded position, the unloaded position of the valve operator determining the size of the opening of the bypass port which determines a desired pressure drop across the bypass port, deriving a valve operator operating force resulting from flow through the bypass port of the valve, coupling the valve operator operating force derived from flow through the bypass port to the valve operator to smoothly transfer the valve operator from the unloaded position in which the bypass port is open to a loaded position in which the bypass port is closed and fluid flows from the inlet to the working outlet, and unloading the hydraulic pump by transferring the valve operator from the loaded to the unloaded position in which fluid flows to the bypass outlet.

24. A method as claimed in claim 23 wherein the operating force is derived from the pressure drop across the bypass port.

25. A method as claimed in claim 24 wherein the valve operator moves from the unloaded to the loaded position when the pressure drop across the bypass port is on the order of 50 psi.

26. A method as claimed in claim 23 wherein the valve operator operating force is coupled to the valve operator by means including a directional control valve which connects fluid flow from the inlet to the valve operator.

27. A method as claimed in claim 23 wherein the means to adjust the unloaded position of the valve operator and the size of the opening of the bypass port include imposing spacers in line with the valve operator to adjust the unloaded position of the valve operator so that the bypass port is substantially open for high flow rates and the bypass port opening is substantially smaller for lower flow rates.

* * * * *

UNITED STATES PATENT AND TRADEMARK OFFICE

CERTIFICATE OF CORRECTION

PATENT NO. : 5,156,177

DATED : October 20, 1992

INVENTOR(S) : DAVID R. BISHOFF

It is certified that error appears in the above-identified patent and that said Letters Patent is hereby corrected as shown below:

TITLE PAGE:

[56] References Cited

U.S. Patent Documents

"2,135,949" dated 8/1938 to O'Conner should be -- 2,125,949 --.

Column 3, line 20, delete "1" and substitute therefor -- 18 --;

Column 6, line 14, after "reference" add -- to the schematics of figs. 1-4. While the lines 52, 54, 56, --;

Column 7, line 63, after "by a" add -- relatively large orifice 70a. In this embodiment, the --; and Column 11, line 7, delete "21" and substitute therefor -- 24 --.

UNITED STATES PATENT AND TRADEMARK OFFICE

CERTIFICATE OF CORRECTION

PATENT NO. : 5,156,177

DATED : October 20, 1992

INVENTOR(S) : David R. Bishoff

It is certified that error appears in the above-indentified patent and that said Letters Patent is hereby corrected as shown below:

Column 11, line 57, delete "work" and substitute therefor -- working --.

Signed and Sealed this

Fifth Day of October, 1993

*Attest:*

*Attesting Officer*

BRUCE LEHMAN

*Commissioner of Patents and Trademarks*